US009964375B2

(12) United States Patent
Fumia et al.

(10) Patent No.: US 9,964,375 B2
(45) Date of Patent: May 8, 2018

(54) HAMMER SEAR ASSEMBLY

(71) Applicant: American Classic Arms, LLC, Wayland, NY (US)

(72) Inventors: David Theodore Fumia, Rochester, NY (US); Ronald Herman Kohlstaedt, Wayland, NY (US)

(73) Assignee: American Classic Arms, LLC, Wayland, NY (US)

( * ) Notice: Subject to any disclaimer, the term of this patent is extended or adjusted under 35 U.S.C. 154(b) by 0 days. days.

(21) Appl. No.: 14/936,116

(22) Filed: Nov. 9, 2015

(65) Prior Publication Data

US 2017/0131053 A1 May 11, 2017

(51) Int. Cl.
*F41A 19/12* (2006.01)
*F41A 19/14* (2006.01)

(52) U.S. Cl.
CPC ..... *F41A 19/12* (2013.01); *F41A 19/14* (2013.01)

(58) Field of Classification Search
CPC ..... F41A 19/12; F41A 19/14; F41A 19/42; F41A 19/45
See application file for complete search history.

(56) References Cited

U.S. PATENT DOCUMENTS 2,140,946 A 12/1938 Swartz
3,079,718 A * 3/1963 Allyn ..... F41A 3/72 42/16
4,306,487 A * 12/1981 Beretta ..... F41A 17/64 42/70.08
4,555,861 A 12/1985 Khoury
6,412,206 B1 7/2002 Strayer
7,421,937 B1 * 9/2008 Gangl ..... F41A 17/46 42/69.03
7,698,845 B2 * 4/2010 Hochstrate ..... F41A 17/72 42/69.01
7,861,640 B2 1/2011 Lippard
8,132,352 B2 * 3/2012 Lippard ..... F41A 17/56 42/1.06
8,312,658 B2 11/2012 Lippard
2014/0338522 A1 * 11/2014 Bellione ..... F41A 3/12 89/139

OTHER PUBLICATIONS

Sear (firearm) from Wikipedia 2 pages last updated Sep. 7, 2014.

* cited by examiner

*Primary Examiner* — Stephen Johnson
*Assistant Examiner* — Joshua T Semick
(74) *Attorney, Agent, or Firm* — Brian B. Shaw, Esq.; Harter Secrest & Emery LLP

(57) ABSTRACT

A hammer and a sear for a fire control system includes a safety notch and a spaced apart triggering surface on the hammer and a firing contact surface and a safety contact surface on the sear. The firing contact surface of the sear is precluded from contacting the safety notch of the hammer in both a safety position of the hammer and the sear and a firing position of the hammer and the sear. Further, a normal to the firing contact surface extends through a pivot pin that provides rotation of the sear.

16 Claims, 8 Drawing Sheets

HAMMER SEAR ASSEMBLY

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

Field of the Invention

The present disclosure relates to fire control systems for firearms and particularly to hammer sear assemblies and more particularly to a hammer sear set for pistols, such as the M1911.

Description of Related Art

Firearms, while typically fabricated to specific dimensions and tolerances often represent a balance between competing design and manufacturing considerations.

These balances have created markets for modification or customization of the firearms. In addition, normal wear on firearm components often requires modification, adjustment or replacement of the components.

As hammers and sears provide critical actions of the firearm as well as give the operator tactile feedback, there is a need to provide hammer and sear set for firearms.

BRIEF SUMMARY OF THE INVENTION

In one configuration, a fire control system for a firearm is provided, wherein the fire control system includes a hammer having a safety notch and a spaced apart triggering surface; and a sear having (i) a safety contact surface for engaging the safety surface in a safety position of the hammer and the sear and (ii) a firing contact surface for engaging the triggering surface in a firing position of the hammer and the sear.

In a further configuration, the firing contact surface is precluded from contacting the safety notch in both the safety position of the hammer and the sear and the firing position of the hammer and the sear.

A further fire control system for a firearm includes a hammer having a safety notch and a spaced apart triggering surface; a sear having (i) a safety contact surface for engaging the safety notch and (ii) a firing contact surface for engaging the triggering surface; and wherein the firing contact surface is precluded from contacting the safety notch in both a safety position of the hammer and the sear and a firing position of the hammer and the sear.

In a further configuration, the firing contact surface is precluded from contacting the triggering surface.

A method is disclosed including the steps of forming a hammer for rotation about a hammer pivot axis, the hammer having a safety notch and a spaced apart triggering surface; forming a sear for rotation about a sear pivot axis, the sear having (i) a safety contact surface for engaging the safety notch in a safety position of the hammer and the sear and (ii) a firing contact surface for engaging the triggering surface in a firing position of the hammer and the sear; and locating the hammer and the sear to (i) engage the safety contact surface with the safety notch in a safety position of the hammer and the sear and (ii) engage the firing contact surface with the triggering surface in a firing position of the hammer and the sear.

BRIEF DESCRIPTION OF THE SEVERAL VIEWS OF THE DRAWING(S)

DETAILED DESCRIPTION OF THE INVENTION

Figure 1:
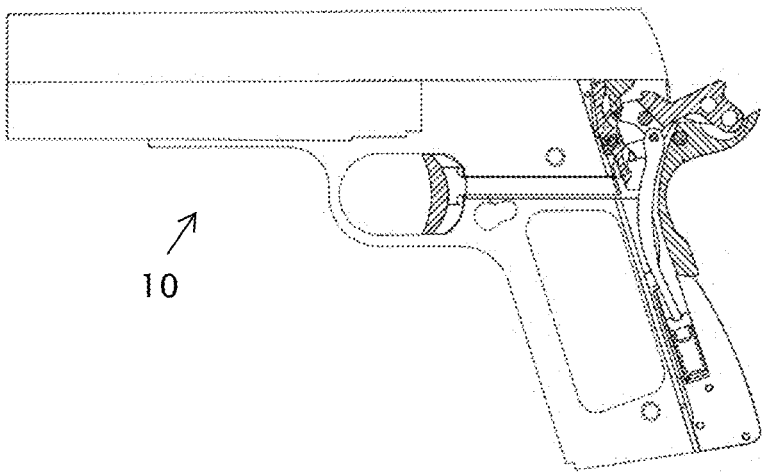
FIG. 1 is a side elevational view of a firearm with a portion of a fire control system shown in cross section.
Figure 2:
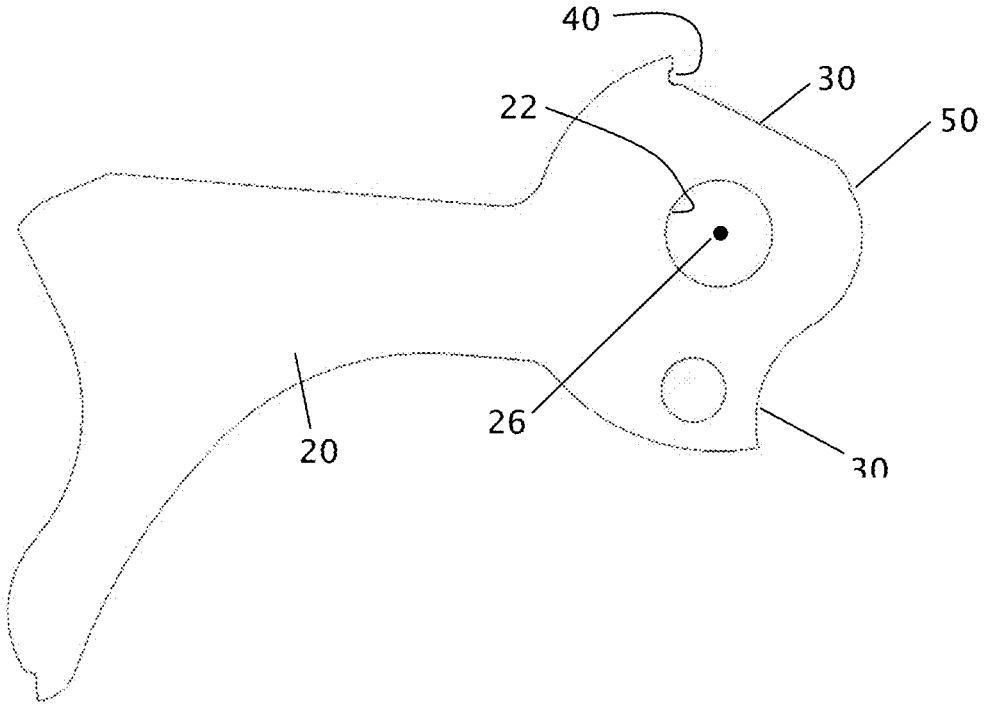
FIG. 2 is a cross section showing a profile of a hammer for the present fire control system.
Figure 3:
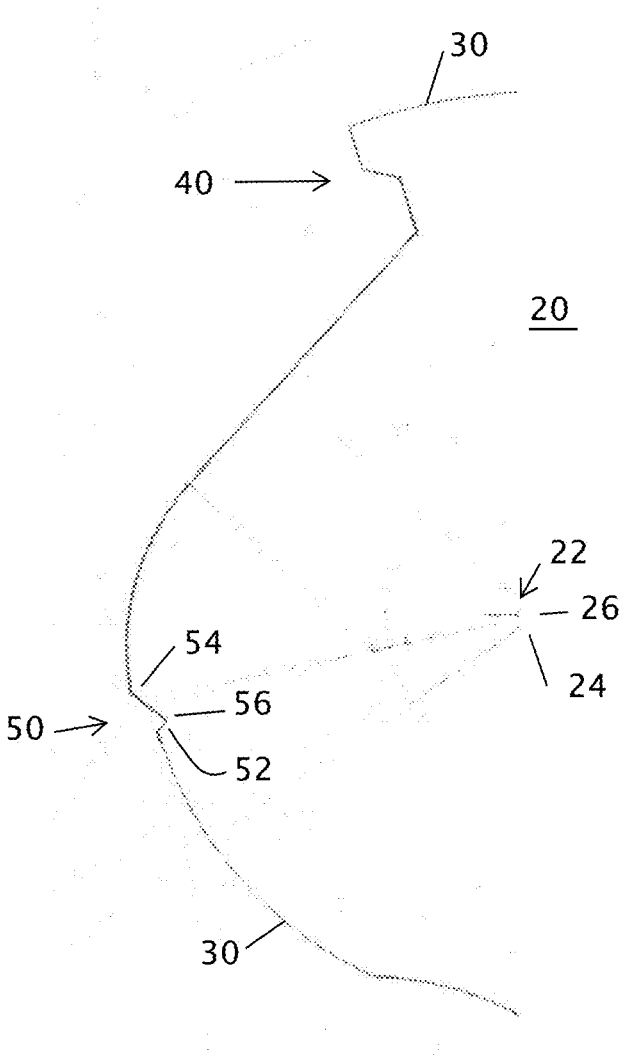
FIG. 3 is an enlarged cross sectional view of a portion of the hammer of FIG. 2.
Figure 4:
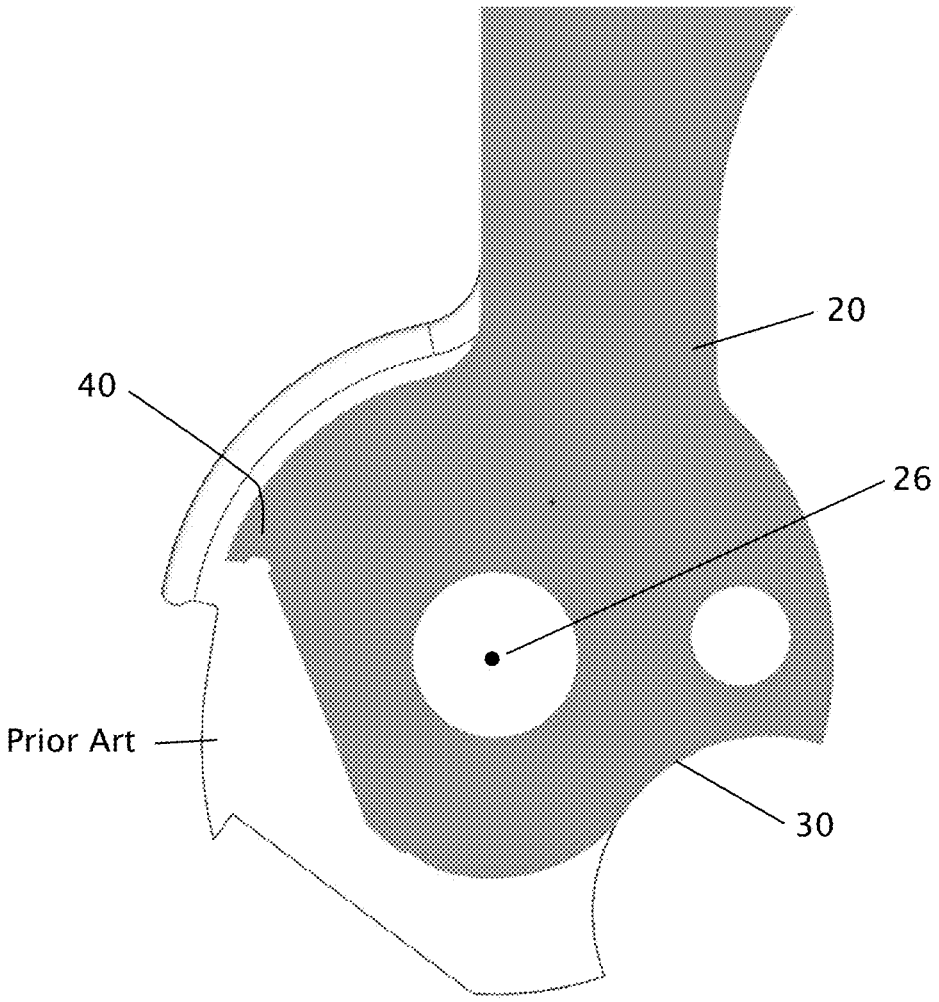
FIG. 4 is a plan view of the hammer of FIG. 2 over a plan view of a prior art hammer.

The present system includes a hammer 20 and a sear 60 of FIGS. 2-4. In one configuration, the hammer and the sear are configured for "drop in" use in a firearm 10 shown in FIG. 1. The hammer 20 and the sear 60 are moveable, by rotation about a respective axis of rotation, between a safety position and a cocked position, wherein the hammer and the sear selectively contact in the safety position (configuration) and the cocked position (configuration) as described herein.

The term firearm 10 includes guns, such as rifles, shotguns, handguns, pistols, muzzle loaders, machine guns and cannons, wherein the motive energy can be from chemical or mechanical storage.

For purposes of illustration, the hammer 20 and the sear 60 are set forth in terms of a single-action, semi-automatic, magazine-fed, recoil-operated pistol, such as but not limited to a M1911. However, it is understood the hammer and sear can be employed in other firearms.

Figure 7:
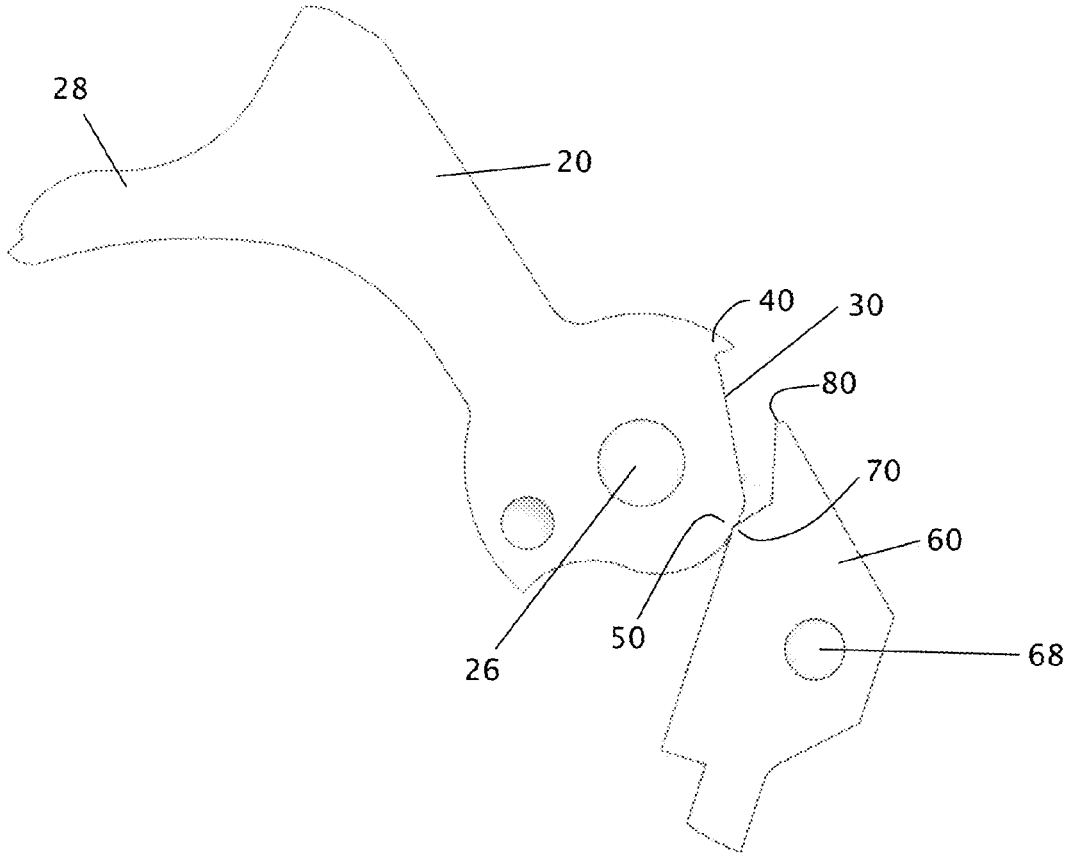
FIG. 7 is a cross sectional view of a portion of the sear of FIG. 5 engaged with the hammer of FIG. 2 in a cocked position.
Figure 9:
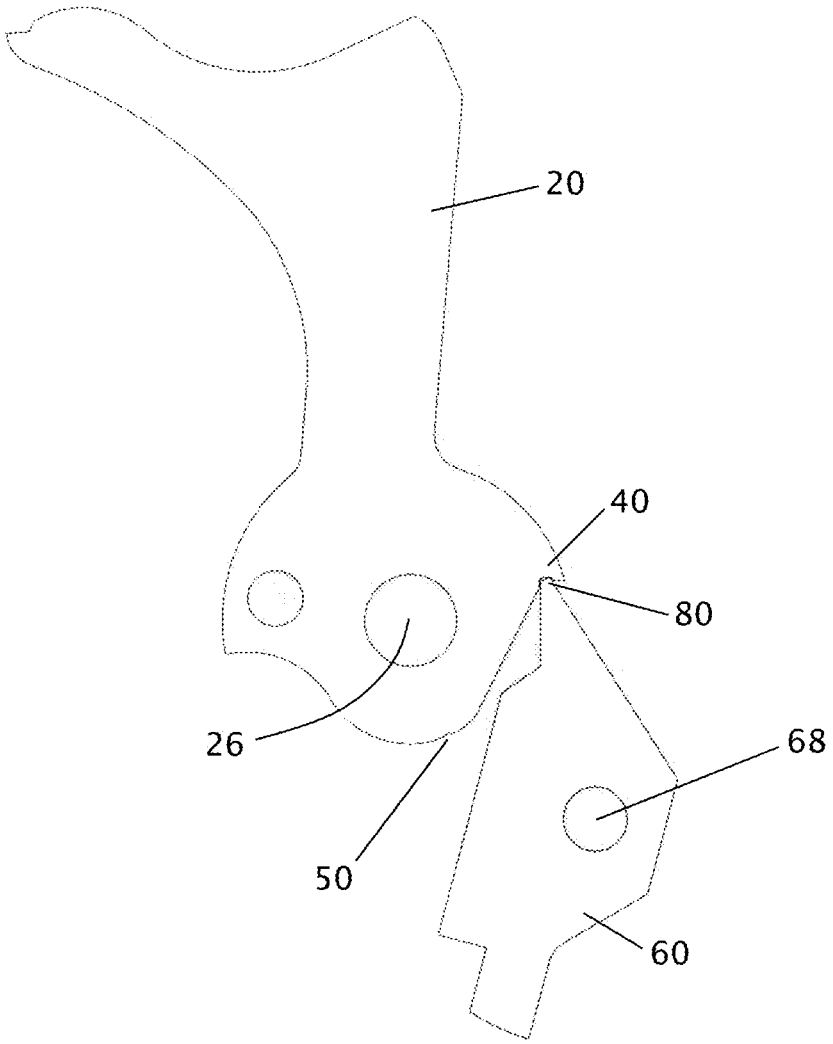
FIG. 9 is a cross sectional view of a portion of the sear of FIG. 5 engaged with the hammer of FIG. 2 in a safety position.

Referring to FIGS. 2 and 3, the hammer 20 includes a pin hole 22 and spur 28 (seen in FIGS. 2, 7, and 9). The pin hole 22 is sized to receive a hammer pin 24 for rotation about a hammer pivot axis 26. While the hammer 20 is shown as having the pin hole 22 to receive the hammer pin 24, it is understood the hammer can be formed with one or a pair of collinear arms, lugs or posts, which in turn are received or captured in sockets or recesses. The spur 28 can have any of a variety of configurations.

In one configuration, the hammer 20 has a peripheral surface 30 defining a periphery that, along with the hammer, rotates about the hammer pivot axis 26.

The peripheral surface 30 of the hammer 20 includes a hammer safety notch 40, and a spaced apart triggering surface 50. The spacing of the hammer safety notch 40 from the triggering surface is both along the peripheral surface 30 as well as an angle of rotation of the hammer about the hammer pivot axis 26. For example, the triggering surface 50 can be spaced from hammer safety notch 40 by at least approximately 70° degrees of rotation in certain configurations, by at least approximately 80° in other configurations and up to approximately 110° in further configurations. In one configuration, the triggering surface 50 is spaced from the hammer safety notch 40 by an angle of rotation between approximately 75° to approximately 85°.

The safety notch 40 is spaced from the triggering surface 50 a sufficient distance to preclude simultaneous contact of the sear 60 with the safety notch and the triggering surface. This avoidance of contact can be accomplished through the spacing of the triggering surface 50 and the hammer safety notch 40 as well as the profile of the periphery of the hammer 20, the sear 60 or both the hammer and the sear.

The hammer safety notch 40 can have a variety of configurations, though the specific profile is typically dictated by design specifications of the firearm. The hammer safety notch 40 is sometimes referred to as the safety notch or ledge.

As seen in FIG. 3, the triggering surface 50 is a substantially planar surface. In one configuration, a portion of the planar triggering surface 50 is recessed from an adjacent portion of the periphery of the hammer 20 and thus defines a generally indent shaped recess in the periphery of the hammer, wherein the recess includes the flat surface. The recess can also include a shoulder or ramp 52 to the adjacent portion of the periphery 30. As described herein, the depth of the triggering surface 50 from the adjacent portion of the hammer periphery is selected to preclude material interference or contact of the hammer 20 and the sear 60 at areas adjacent the triggering surface.

In one configuration, the triggering surface 50 intersects an adjacent portion of the periphery of the hammer at a proximal end 54 and extends for a length to terminate at a distal end 56, wherein the distal end is recessed from an adjacent portion of the hammer periphery. While the configuration of FIGS. 2-4 and 7-9 depict the triggering surface 50 as a planar segment, it is understood triggering surface can be curvilinear or faceted, wherein the force of the hammer 20 on the sear 60 resolves as set forth below.

The safety notch 40 is sized to engage the sear 60 in a safety configuration of the firearm as is known in the art.

Figure 5:
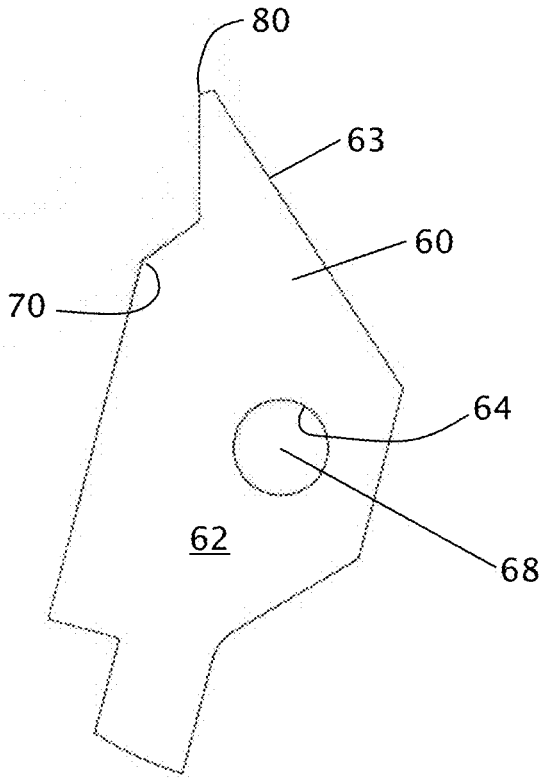
FIG. 5 is a cross section showing a profile of a sear for the present fire control system.
Figure 6:
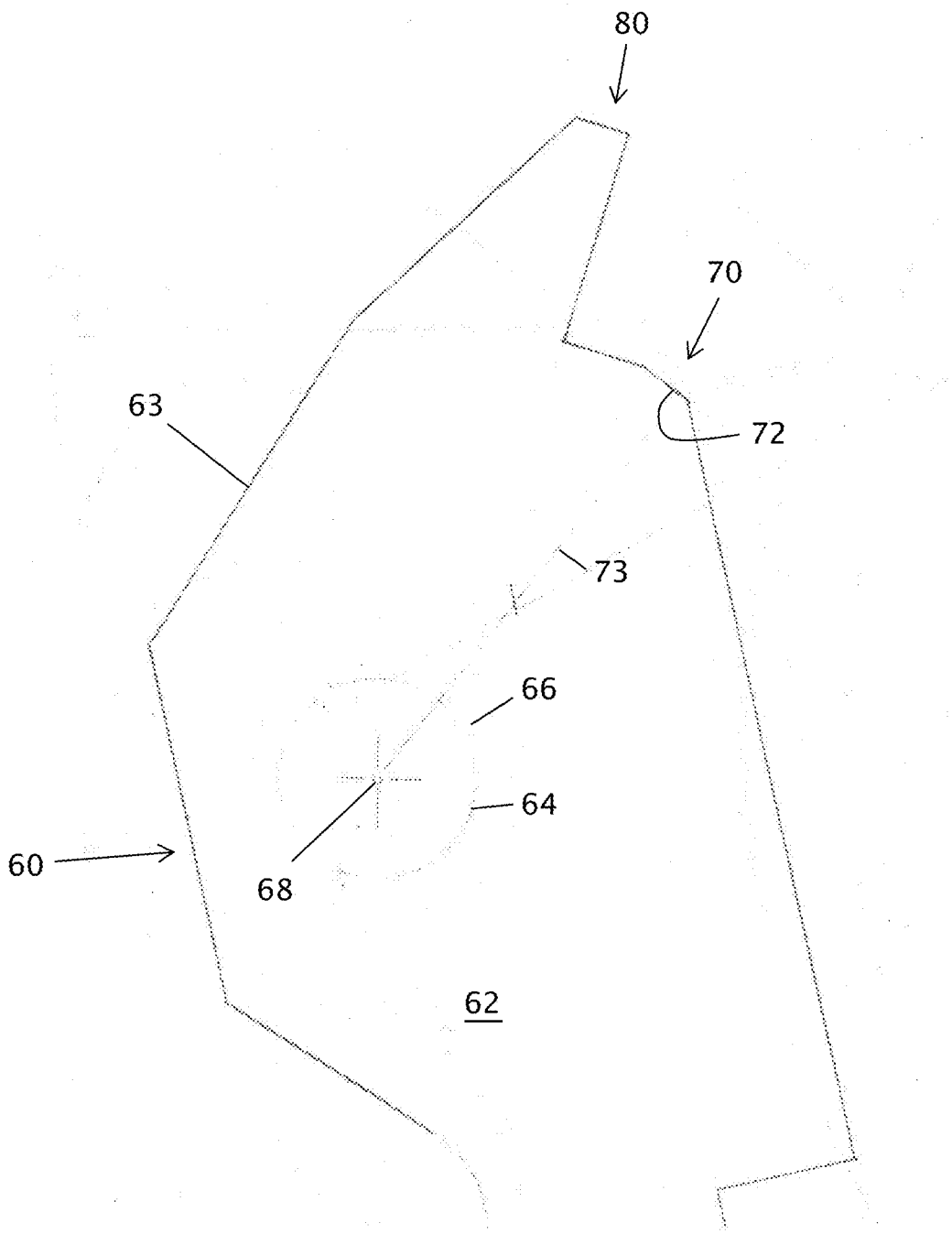
FIG. 6 is a cross sectional view of a portion of the sear of FIG. 5.

As seen in FIGS. 5 and 6, the sear 60 includes a body 62 having a sear pin hole 64 for receiving a sear pin 66 for rotation about a sear pivot axis 68. While the sear 60 is shown as having the sear pin hole 64 to receive the sear pin 66, it is understood the sear can be formed with one or a pair of collinear arms, lugs or posts, which in turn are received or captured in sockets or recesses to provide for rotation of the sear about the sear pivot axis 68.

The sear 60 includes a firing contact surface 70 and a safety contact surface 80. In one configuration, the firing contact surface 70 and the safety contact surface 80 are located along a periphery 63 of the sear. The periphery, with the sear 60, rotates about the sear pivot axis 68. The spacing of the firing contact surface 70 and the safety contact surface 80 along the peripheral surface of the sear can be defined by an angle of rotation between approximately 10° to 30°, with an angle of approximately 20° in select configurations.

The firing contact surface 70 includes a planar segment 72 having a normal 73 that extends through at least one of the sear pin 66 or the pair of collinear arms, lugs or posts, if employed. In select configurations of the sear 60, the normal 73 to the firing contact surface 70 extends through, intersects, the sear pivot axis 68 or is within at least one diameter of the sear pin 66.

Figure 8:
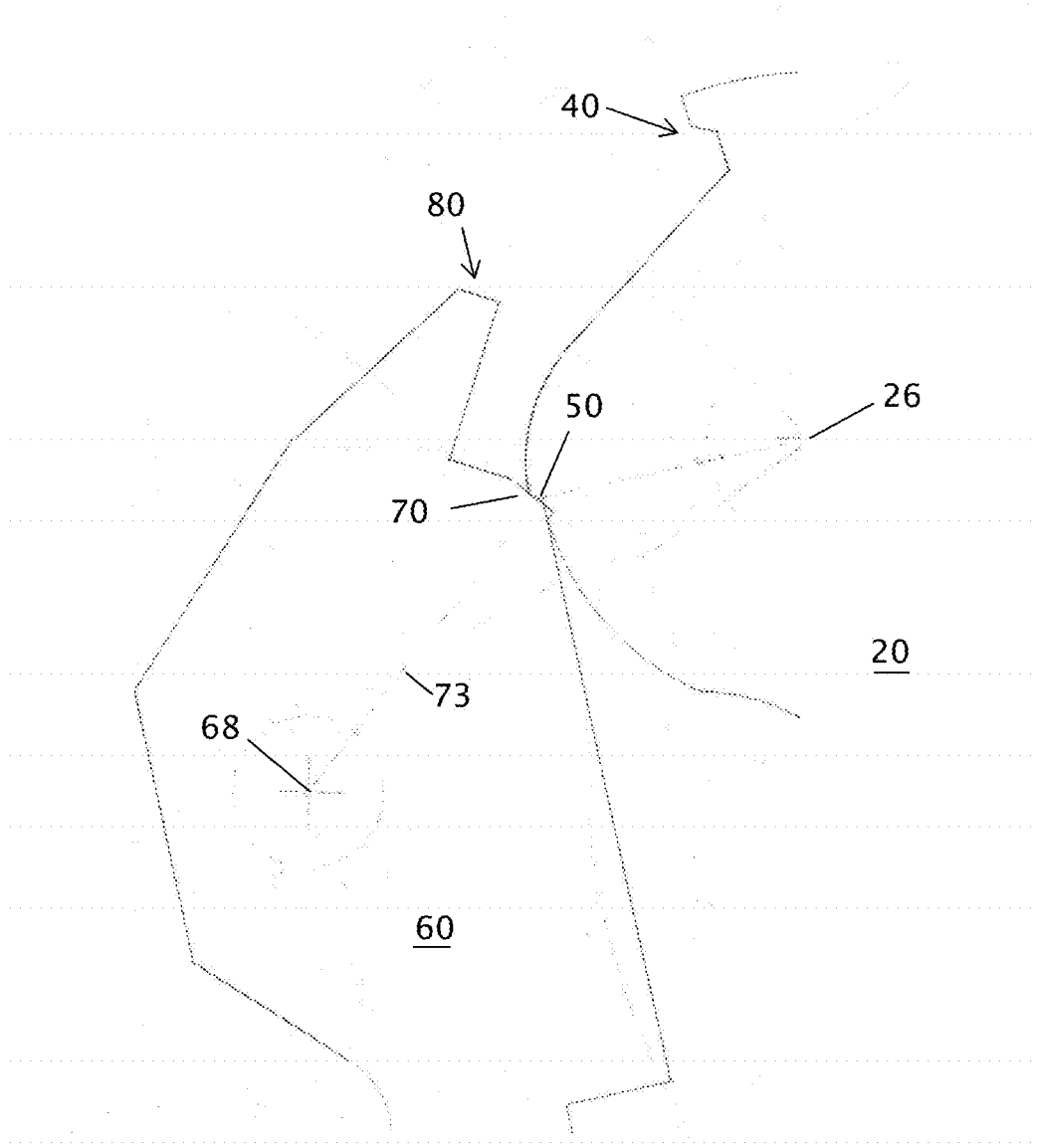
FIG. 8 is an enlarged cross sectional view of a portion of the sear of FIG. 5 engaged with the hammer of FIG. 2 in the cocked position.

The firing contact surface 70 is sized to cooperatively engage the triggering surface 50 in the cocked position of the hammer and the sear as seen in FIGS. 7 and 8.

In one configuration, the firing contact surface 70 extends the thickness (or width) of the sear 60 and has a length sufficient to engage the triggering surface 50 such that the force of the hammer 20 on the sear resolves to substantially pass through at least the sear pin 66 and in certain configurations, through the sear pivot axis 68.

The safety contact surface 80 is spaced from the firing contact surface 70 and configured to engage the safety notch 40 of the hammer 20. It is understood, that the safety contact surface 80 can be a collection of relatively closely spaced points or adjacent surfaces for contacting corresponding points or adjacent surfaces of the safety notch. Thus, the safety contact surface 80 can include a planar portion, a plurality of facets or curvilinear surfaces for contacting the safety notch 40.

Upon being operably located within the firearm 10 to rotate about the respective axis, the hammer 20 and the sear 60 are moveable between the cocked (firing) position and the safety position.

In the firing position, movement or rotation of the sear 60 allows the hammer 20 to rotate to cause a firing of the firearm 10. In the firing position, the firing contact surface 70 of the sear 60 engages the triggering surface 50 of the hammer 20. In one instance of the firing position, the engagement of the firing contact surface 70 and the triggering surface 50 occurs along a common plane confronted by both surfaces.

In this firing position, the force applied by the hammer 20 on the sear 60 is at least substantially normal to the firing contact surface 70. As the normal to the firing contact surface 70 extends through the sear pin 66, and in select configurations through the sear pivot axis 68, the load on the sear 60 does not create a moment (or any material moment) about the sear pin or the sear pivot axis. That is, in the firing position, the hammer bias against the sear 60 does not urge a rotation (or a material rotation) of the sear. In select configurations, the normal to the firing contact surface 72 is sufficiently close to intersecting the sear pivot axis 68, that any moment acting on the sear 60 under intending operating parameters of the hammer 20 permits the firing contact surface 70 and the triggering surface 50 to be configured as planar surfaces.

Further referring to FIG. 8, in a triangle formed by the hammer pivot axis 26, the sear pivot axis 68 and the firing contact surface 70 in the cocked position of the hammer 20 and the sear 60, the leg of the triangle extending from the sear pivot axis to the firing contact surface is longer than the leg of the triangle extending from the hammer pivot axis to the firing contact surface.

Upon actuation of a trigger, the sear 60 is rotated about the sear pin 66 (and hence about the sear pivot axis 68). This rotation of the sear 60 causes the firing contact surface 70 of the sear 60 to disengage the triggering surface 50 of the hammer 20, thereby allowing the hammer to fall or drop and cause a firing of the firearm 10.

During the firing rotation of the hammer 20, the hammer safety notch 40 rotates past the firing contact surface 70 of the sear 60 without contact. In one configuration, the hammer 20 and the sear 60 are selected to preclude contact of the firing contact surface 70 of the sear with the hammer, other than at the triggering surface 50. Thus, the hammer safety notch 40 is precluded from contacting the firing contact surface 70 of the sear 60. By isolating the firing contact surface 70 of the sear 60 from contact with anything other than the triggering surface 50 of the hammer 20, the dimensions of the firing contact surface are better maintained and wear is reduced. That is, as the firing contact surface 70 of the sear 60 cannot "fall" to contact the hammer 20, the tolerances or shaping of the firing contact surface are not subject to degradation from unintended contact of the firing contact surface. This also provides the maintenance of the operating parameters of the hammer 20 and the sear 60, thereby providing for the hammer sear set to be readily installed into the firearm 10, without requiring refinishing or polishing of the components.

In the safety position of the hammer 20 and the sear 60, the safety contact surface 80 of the sear 60 engages the hammer safety notch 40, thereby precluding rotation of the hammer. In the safety position, the firing contact surface 70 of the sear 60 is spaced from the hammer 20 and does not contact the hammer. In one configuration, the firing contact surface 70 is precluded from contacting the hammer safety notch 40 of the hammer 20.

The hammer safety notch 40 and the triggering surface 50 of the hammer 20 are selected and configured in cooperation with the firing surface 70 and the safety contact surface 80 of the sear 60, wherein the firing contact surface of the sear is precluded from contacting the safety notch of the hammer in both the safety position of the hammer and the sear and the firing position of the hammer and the sear.

As the present hammer 20 and sear 60 can be constructed as a set and "dropped in" a firearm, the hammer and the sear provide repeatable sear pressure, trigger pressure as well as sear position and hammer position.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A fire control system for a firearm, the fire control system comprising:

(a) a hammer having a safety notch and a spaced apart triggering surface; and (b) a sear having (i) a safety contact surface for engaging the safety notch in a safety position of the hammer and the sear and (ii) a firing contact surface for engaging the triggering surface in a firing position of the hammer and the sear, a distance between the safety contact surface and the firing contact surface is fixed as the sear moves between the firing position and the safety position;

wherein engagement of the firing contact surface and the triggering surface retains the hammer in the firing position with the safety contact surface being spaced from the hammer.

2. The fire control system of claim 1, wherein the hammer includes a peripheral surface, wherein the safety notch and the triggering surface are located on the peripheral surface.

3. The fire control system of claim 1, wherein the hammer is rotatably mounted to a hammer pin.

4. The fire control system of claim 1, wherein the sear is rotatably mounted to a sear pin.

5. The fire control system of claim 1, wherein the firing contact surface is precluded from contacting the safety notch in both the safety position of the hammer and the sear and the firing position of the hammer and the sear.

6. The fire control system of claim 1, wherein the firing contact surface is planar.

7. The fire control system of claim 1, wherein the sear is rotatably mounted to a sear pin and a normal to the firing contact surface intersects the sear pin.

8. The fire control system of claim 1, wherein movement of the firing contact surface from the triggering surface causes a firing of the firearm.

9. The fire control system of claim 1, wherein the sear is rotatable about a sear pivot axis and a normal to the firing contact surface intersects the sear pivot axis.

10. A fire control system for a firearm, the fire control system comprising: (a) a hammer having a safety notch and a spaced apart triggering surface; (b) a one piece sear having (i) a safety contact surface for engaging the safety notch and (ii) a firing contact surface for engaging the triggering surface; and (c) wherein the firing contact surface is precluded from contacting the safety notch in both a safety position of the hammer and the one piece sear and a firing position of the hammer and the one piece sear and wherein the safety contact surface is spaced from the hammer upon engagement of the firing contact surface and the triggering surface.

11. The fire control system of claim 10, wherein the safety contact surface includes a planar portion.

12. The fire control system of claim 10, wherein in the safety position, the firing contact surface is precluded from contacting the hammer.

13. The fire control system of claim 10, wherein the one piece sear is rotatable about a sear pivot axis and a normal to the firing contact surface intersects the sear pivot axis.

14. The fire control system of claim 10, wherein the one piece sear is rotatably mounted to a sear pin and a normal to the firing contact surface intersects the sear pin.

15. The fire control system of claim 10, wherein the firing contact surface is planar.

16. A method comprising: (a) locating a hammer and a sear in a firearm, wherein the hammer is configured for rotation about a hammer pivot axis, the hammer having a safety notch and a spaced apart triggering surface and the sear is configured for rotation about a sear pivot axis, and wherein the sear includes (i) a safety contact surface for engaging the safety notch in a safety position of the hammer and the sear and (ii) a firing contact surface at a fixed distance relative to the safety contact surface for engaging the triggering surface in a firing position of the hammer and the sear, and the locating the hammer and the sear causes (i) the safety contact surface to engage with the safety notch in a safety position of the hammer and the sear and (ii) the firing contact surface to engage with the triggering surface in a firing position of the hammer and the sear, and wherein engagement of the firing contact surface and the triggering surface retains the hammer in the firing position with the safety contact surface being spaced from the hammer.

* * * * *